US007510752B1

(12) United States Patent
Robertson

(10) Patent No.: US 7,510,752 B1
(45) Date of Patent: Mar. 31, 2009

(54) ROLLED MEMBRANE WITH COMPRESSION SPACERS

(75) Inventor: Ross Hartford Robertson, Cicero, IN (US)

(73) Assignee: BFS Diversified Products, LLC, Indianapolis, IN (US)

( * ) Notice: Subject to any disclaimer, the term of this patent is extended or adjusted under 35 U.S.C. 154(b) by 217 days.

(21) Appl. No.: 11/417,055

(22) Filed: May 4, 2006

(51) Int. Cl.
*B32B 9/00* (2006.01)
*B32B 33/00* (2006.01)

(52) U.S. Cl. ..... 428/40.1; 428/42.3

(58) Field of Classification Search ..... 428/40.1, 428/42.3, 43
See application file for complete search history.

(56) References Cited

U.S. PATENT DOCUMENTS

| | | | | |
|---|---|---|---|---|
| 2,589,202 | A | | 8/1948 | Newman |
| 2,805,183 | A | | 9/1957 | Higgins |
| 3,205,972 | A | | 9/1965 | Stricker et al. |
| 3,386,527 | A | | 6/1968 | Daubert et al. |
| 3,575,289 | A | | 4/1971 | Brousse |
| 3,674,614 | A | | 7/1972 | Templeton |
| 5,182,156 | A | | 1/1993 | Pape et al. |
| 5,330,814 | A | | 7/1994 | Fewell |
| 5,332,607 | A | | 7/1994 | Nakamura et al. |
| 5,806,271 | A | * | 9/1998 | Van Someren et al. ..... 52/750 |
| 5,916,654 | A | | 6/1999 | Phillips et al. |
| 6,362,388 | B1 | | 3/2002 | Lucas |
| 6,458,440 | B1 | | 10/2002 | Merritt |
| 2004/0048026 | A1 | | 3/2004 | Kan |
| 2004/0154265 | A1 | | 8/2004 | Knowlton |
| 2004/0185218 | A1 | | 9/2004 | Knowlton |
| 2004/0187438 | A1 | | 9/2004 | Clarke et al. |

* cited by examiner

*Primary Examiner*—Patricia L Nordmeyer
(74) *Attorney, Agent, or Firm*—Sarah M. Jabbari; Finnegan Henderson

(57) ABSTRACT

A rolled membrane includes a core member and a membrane having a width defined by a first edge and a second edge. The membrane can be rolled around the core member such that the first edge and the second edge are exposed. A pre-applied seam tape having a substantially uniform thickness is affixed along the first edge. A first and second compression spacer may be located substantially adjacent to the seam tape and the second edge, respectively. The compression spacers have a thickness at least 0.005 inches greater than the thickness of the seam tape. The compression spacers are configured to allow the seam tape to remain in a substantially uncompressed state when the membrane is rolled and, therefore, avoid damage. The compression spacers allow the membrane to be rolled uniformly on the core member without telescoping and with a uniform cross-sectional diameter along the width of the rolled membrane.

15 Claims, 2 Drawing Sheets

ROLLED MEMBRANE WITH COMPRESSION SPACERS

FIELD OF INVENTION

This disclosure relates to rolled membrane materials having a pre-applied seam tape and compression spacers to protect the seam tape in the rolled state.

BACKGROUND

Rolled membrane materials having a pre-applied seam tape have been used for creating a moisture barrier in many applications such as pond liners, roofing membranes, moisture barriers, etc. For many applications, rolled membranes require lap seams for full coverage and moisture protection. For example, a roof may be wider than a rolled membrane, requiring several sections of membrane, joined together, to cover the entire roof surface. A pre-applied seam tape allows for easy installation at a job-site.

Rolling a membrane with a pre-applied seam tape can be challenging because of the added thickness of the seam tape at one edge. A rolled membrane with pre-applied seam tape tends to telescope and roll unevenly. Such deficiencies make the manufacture, shipping, and installation of the rolled membrane difficult. Uneven and telescoping rolls are difficult and inefficient to ship because the uneven roll takes more space than necessary, and extended edges are easily damaged.

Drawing upon well-known techniques, one conventional solution to the problem of uneven rolling is to include strips of material having approximately the same thickness as the seam tape along the body of the rolled membrane. This approach, however, does not adequately solve the problems presented by rolled membranes with pre-applied seam tape. Strips of material with a thickness approximately the same thickness as the seam tape allow compression of the seam tape. When the seam tape is allowed to compress, the adhesive's effectiveness can be diminished and/or the tape can otherwise become damaged. Additionally, rolled membranes with strips of material having a thickness approximately the same thickness as the seam tape tend to become loosely wound, causing telescoping and damage to the membrane and/or the seam tape during storage and transportation.

Accordingly, there is a need for a uniformly rolled membrane having a pre-applied seam tape wherein the seam tape and membrane are protected from damage during the rolling process and in the rolled condition.

SUMMARY OF THE INVENTION

A rolled membrane includes a core member and a membrane having a width defined by a first edge and a second edge. The membrane is rolled around the core member such that the first edge and the second edge are exposed. A pre-applied seam tape having a substantially uniform thickness is affixed along the first edge. A first and second compression spacer may be located substantially adjacent to the seam tape and the second edge, respectively. The compression spacers have a thickness at least 0.005 inches greater than the thickness of the seam tape. The compression spacers are configured to allow the seam tape to remain in a substantially uncompressed state when the membrane is rolled and, therefore, avoid damage. The compression spacers allow the membrane to be rolled uniformly on the core member without telescoping and with a uniform cross-sectional diameter along the width of the rolled membrane.

BRIEF DESCRIPTION OF THE DRAWINGS

The accompanying drawings are incorporated in and constitute part of this specification. The drawings illustrate exemplary embodiments and, together with the description, serve to explain some principles of the invention.

DETAILED DESCRIPTION

Reference will now be made in detail to exemplary embodiments of the invention. Wherever possible, the same reference numbers will be used throughout the drawings to refer to the same or like parts.

Figure 2:
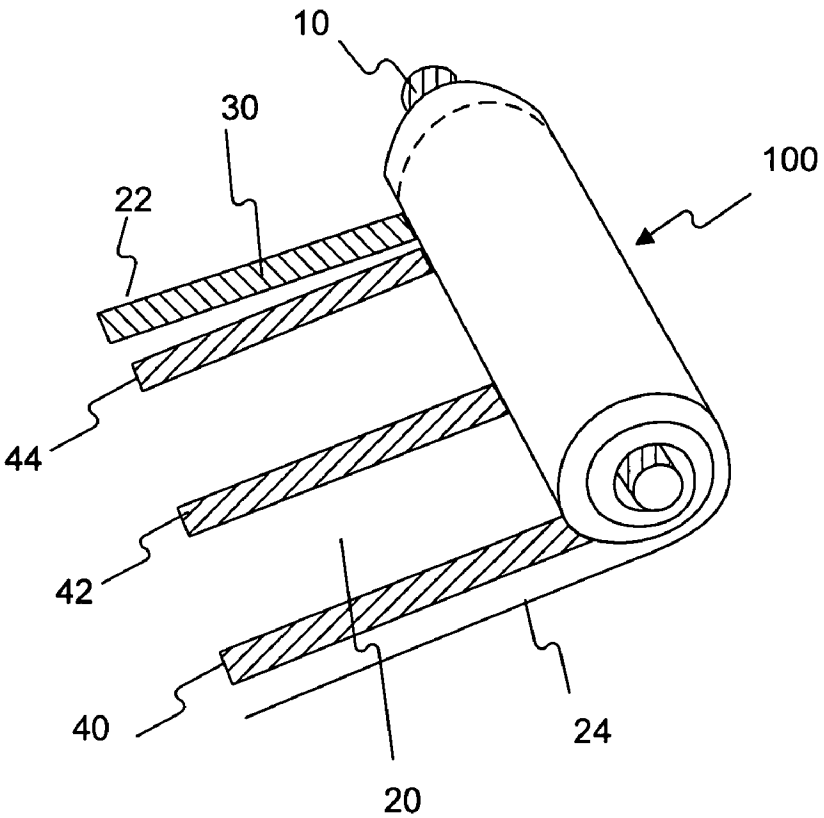
FIG. 2 is an illustration of a second exemplary according to one or more aspects of the invention.
Figure 1:
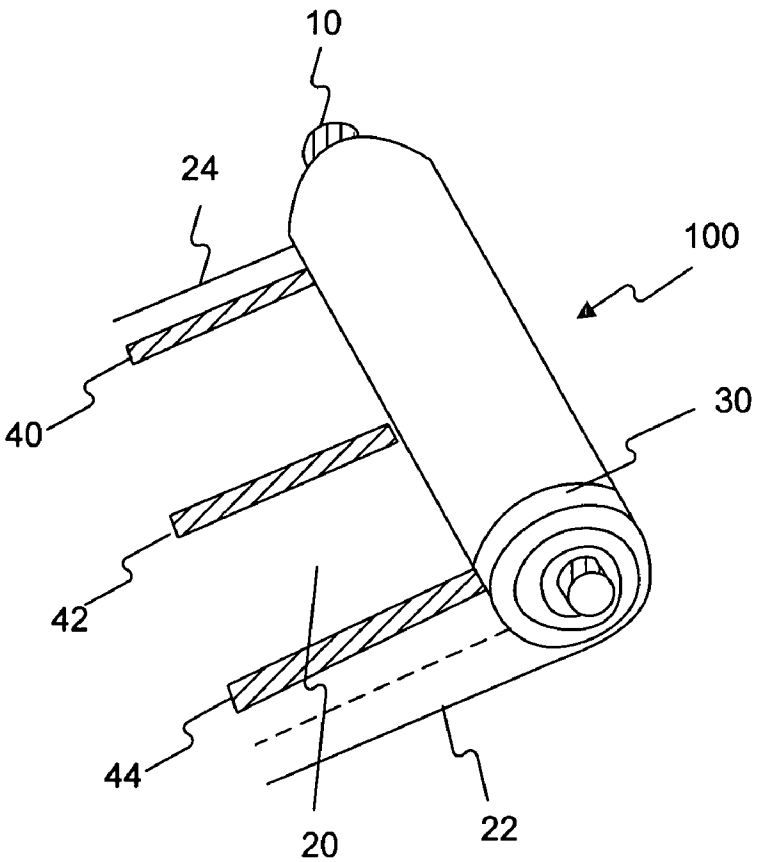
FIG. 1 is an illustration of a first exemplary embodiment according to one or more aspects of the invention.

FIGS. 1 and 2 demonstrate a rolled membrane 100 consistent with two exemplary embodiments. The rolled membrane 100 may include a membrane material 20 wrapped around a core member 10 such that each edge 22, 24 of membrane material 20 is exposed. A pre-applied seam tape 30 may be permanently affixed to membrane material 20 in a known manner such that it runs along edge 24.

In one embodiment, pre-applied seam tape 30 may include a release layer to protect the adhesive. As shown in FIG. 1, membrane material 20 and pre-applied seam tape 30 may be rolled such that pre-applied seam tape 30 is on a side of membrane material 20 that faces away from core member 10 such that the pre-applied seam tape 30 is on the outside surface of the rolled membrane 100. Such a configuration may reduce bunching and separation of the release layer from pre-applied seam tape 30 by placing the release layer in tension by nature of being located on the outside surface of the rolled membrane 100.

In other embodiments, such as shown in FIG. 2, membrane material 20 and pre-applied seam tape 30 may be rolled such that pre-applied seam tape 30 is on a side of membrane material 20 that faces towards the core member. In these embodiments, the pre-applied seam tape 30 is protected on the inside of the rolled membrane 100.

With reference to the embodiments exemplified in FIGS. 1 and 2, a plurality of compression spacers 40, 42, 44 may be included in the field body of the rolled membrane 100. A first compression spacer 40 may be located substantially adjacent to edge 22. A second compression spacer 44 may be located substantially adjacent to pre-applied seam tape 30. One or more additional compression spacers 42 may be located between compression spacers 40, 44.

Figure 3:
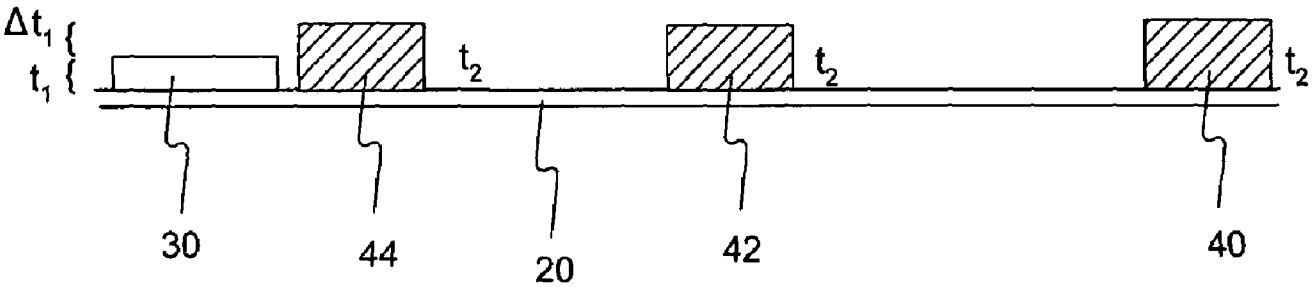
FIG. 3 is a cross sectional diagrammatic illustration demonstrating the relative thicknesses of the seam tape and a plurality of compression spacers in an unrolled and uncompressed state.
Figure 4:
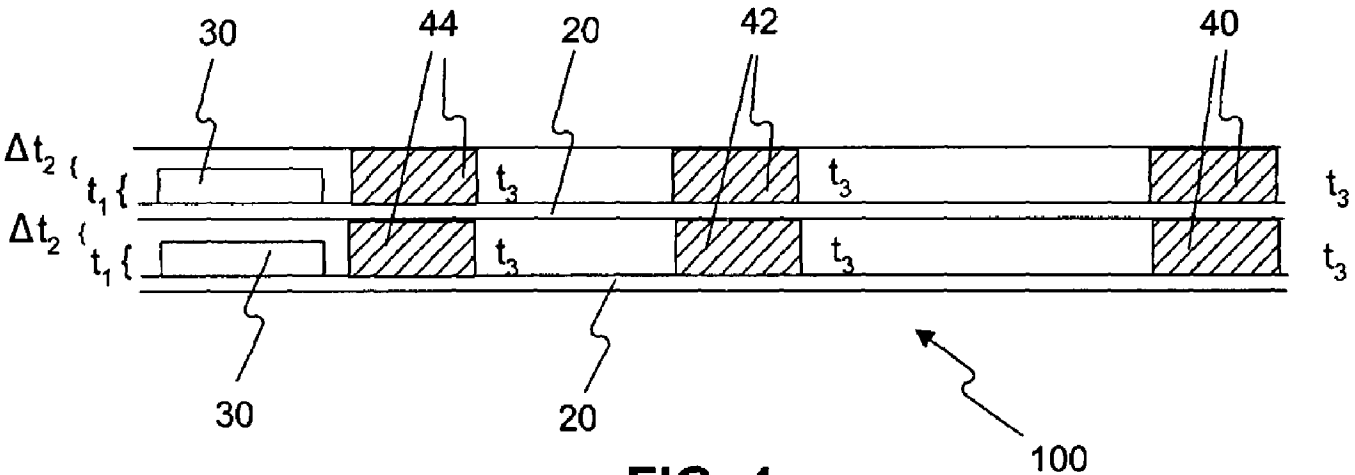
FIG. 4 is a cross sectional diagrammatic illustration demonstrating the relative thicknesses of the seam tape and a plurality of compression spacers in a rolled and compressed state.

FIGS. 3 and 4 are cross sectional diagrammatic illustrations demonstrating the relative thicknesses of pre-applied seam tape 30 and compression spacers 40, 42, 44 in both an unrolled and uncompressed state (FIG. 3), and a rolled and compressed state (FIG. 4). The thicknesses of the compression spacers and seam tape of FIGS. 3 and 4 are exaggerated to illustrate the relative thickness of the seam tape and the compression spacers.

As shown in FIGS. 3 and 4, the compression spacers 40, 42, 44 may be configured to compress when rolled into the rolled membrane 100. FIG. 3 represents one embodiment with the compression spacers 40, 42, 44 in an uncompressed state. In the uncompressed state, each compression spacer 40, 42, 44 has a thickness $t_2$ and the pre-applied seam tape 30 has a thickness $t_1$. The difference between the pre-applied seam tape thickness $t_1$ and the uncompressed compression spacer thickness $t_2$ is represented by $\Delta t_1$.

FIG. 4 represents an embodiment with the compression spacers in a compressed state on the inside of the rolled membrane 100. Because of the inclusion of the compression spacers, the seam tape remains uncompressed in this condition. In the compressed state, each of the compression spacers 40, 42, 44 has a thickness of $t_3$. The difference between the pre-applied seam tape thickness $t_1$ and the compressed compression spacer thickness $t_3$ is represented by $\Delta t_2$. Because compression spacers 40, 42, 44 are compressed in the compressed state, $t_2$ is greater than $t_3$ and $\Delta t_1$ is greater than $\Delta t_2$. In each of the compressed and uncompressed states, compression spacers 40, 42, 44 are thicker than pre-applied seam tape 30.

The disclosed compression spacers are not intended to be limited to specific dimensions. Nevertheless, for purposes of explanation, certain disclosed embodiments will be discussed with respect to particular dimensions. In certain embodiments, the pre-applied seam tape 30, including a release layer, may have a thickness $t_1$ of about 0.032-0.035 inches. Compression spacers 40, 42, 44 may each have an uncompressed thickness $t_2$ of about 0.050 inches and a compressed thickness $t_3$ of about 0.045 inches. In this aspect, $\Delta t_1$ is 0.015-0.018 inches and $\Delta t_2$ is 0.010-0.013 inches. Compression spacers 40, 42, 44 should maintain a thickness of greater than the thickness of the pre-applied seam tape 30, i.e., $\Delta t_1$ and $\Delta t_2$ should be greater than zero, preferably with $\Delta t_2$ greater than about 0.005 inches, to allow for greater control of the rolling process, and to prevent damage to pre-applied seam tape 30.

It is intended that the compression spacers maintain a thickness greater than the seam tape to protect the seam tape itself from being compressed when the membrane is in a rolled condition. Doing so protects the seam tape from being damaged during the rolling process and during subsequent shipment of the rolled membrane. Compression spacers in a compressed state also help maintain roll tightness, which reduces telescoping when moving, storing, or shipping the rolled membrane, such as when the roll is placed on or removed from a storage stack, truck, or shipping container, or is dragged against other rolls in a stack.

Assuming a seam tape thickness of 0.035 inches, in the previously described embodiment wherein the thickness of the uncompressed spacer is 0.050 inches, the compression spacer is approximately 43% thicker than the seam tape when uncompressed. Conversely, when compressed to a thickness of 0.045 inches, the compression spacer is approximately 29% thicker than the seam tape. Thus, the spacer is sufficiently greater in thickness than the seam tape that it prevents the seam tape from becoming compressed and undergoing damage as the membrane is wound into a roll.

In one embodiment, compression spacers 40, 42, 44 are attached to core member 10. One end of membrane material 20, with pre-applied seam tape 30, is also attached to core member 10 such that pre-applied seam tape 30 is located along edge 22 of the membrane material 20 and protected from compression by compression spacers 40, 42, 44. Compression spacer 44 may be located substantially adjacent to pre-applied seam tape 30. Core member 10 may be rotated such that membrane material 20 with pre-applied seam tape 30 and compression spacers 40, 42, 44 are together rolled into rolled membrane 100.

In order to control the thickness of compression spacers 40, 42, 44 in a compressed state, and to control rolling of the membrane material 20 around core member 10, tension may be applied to one or more of compression spacers 40, 42, 44 during the rolling process, causing rolled membrane 100 to tighten with a consequent compression of compression spacer 40, 42, 44 in tension. By applying tension individually to particular compression spacers 40, 42, 44, the shape of the rolled membrane 100 may be controlled and maintained in a uniform roll without telescoping.

Compression spacers 40, 42, 44 may be made of cardboard having a single facing such that one side of each compression spacer is a smooth, flat side and the other side is a corrugated side. In some embodiments, the smooth, flat side may face core member 10 of rolled membrane 100, and the corrugations, or loops, face the outside of rolled membrane 100, allowing the corrugations, or loops, on the corrugated side to open slightly. Slightly open loops on the corrugated side of the compression spacers 40, 42, 44 allow for even compression in rolled membrane 100 because the corrugations, or loops, do not impede the compression of adjacent corrugations or loops.

Alternatively, compression spacers 40, 42, 44 may be made of another material suited to compression such that a final thickness in a compressed state remains thicker than a thickness of pre-applied seam tape 30. For example, compression spacers may be made of various foam materials, plastic (including corrugated plastic having similar shape and function as corrugated cardboard), or any other appropriate material.

Preferred materials for compression spacers 40, 42, 44 should be light and inexpensive for cost-effectiveness in manufacturing, storage, and shipment. Such materials should have compressive properties such that compression spacers 40, 42, 44 maintain a thickness greater than the thickness of pre-applied seam tape 30 during extended vertical or horizontal storage and shipment to protect the pre-applied seam tape 30 and maintain the shape and integrity of rolled membrane 100.

In some embodiments, compression spacers 40, 42, 44 may be removably affixed to membrane material 20 to prevent sliding or shifting of compression spacers 40, 42, 44 during manufacture or shipment of rolled membrane 100. Compression spacers 40, 42, 44 may be removably affixed with adhesives or other known techniques such that compression spacers 40, 42, 44 may be readily removed from membrane material 20 without causing any damage to membrane material 20.

In other embodiments, compression spacers 40, 42, 44 may not be affixed to membrane material 20. In such embodiments, compression spacers 40, 42, 44 are prevented from shifting by nature of the compression between layers of membrane material 20 in rolled membrane 100.

Compression spacers 40, 42, 44 may be a continuous strip or a plurality of non-continuous sections of materials placed in rolled membrane 100. For example, a compression spacer may include several sections having uniform and/or varied lengths placed in rolled membrane 100 during the rolling process as needed. Strategic placement of discrete sections of compression spacers 40, 42, 44 may allow greater control of the shape and uniformity of rolled membrane 100.

While the exemplary embodiment of FIGS. 1 and 2 utilize three compression spacers, any suitable number of compression spacers may be used. For example, a single compression spacer may have a width that is a significant percentage of the width of rolled membrane 100, and positioned to allow for an evenly rolled membrane 100. Such a single compression spacer may be approximately the width of membrane material 20, not including pre-applied seam tape 30. Similarly, several thinner compression spacers may be spaced along the width of rolled membrane 100, either symmetrically or non-symmetrically.

In some embodiments, core member 10 may be wider than a width of membrane material 20 to protect edges 22, 24 and pre-applied seam tape 30 from damage. Core member 10 may also have a relatively large diameter to help prevent damage to pre-applied seam tape 30 during the rolling process.

The rolled membrane described herein may be made of any number of different materials and be used for any number of applications. For example, the membrane may be utilized for roofing, pond liners, or moisture barrier applications. Typically, membranes used for such purposes include a polymeric material such as EPDM.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

The invention claimed is:

1. A rolled membrane, comprising:

a core member;

a membrane having a width defined by a first edge and a second edge, the membrane being rolled around the core member such that the first edge and the second edge are exposed;

a pre-applied seam tape affixed along the first edge, wherein the seam tape has a substantially uniform thickness; and a first and second compression spacer located substantially adjacent to the seam tape and the second edge, respectively, wherein the compression spacers are configured to have a thickness at least 0.005 inches greater than the thickness of the seam tape when the compression spacers are in a compressed state to allow the seam tape to remain in a substantially uncompressed state when rolled.

2. The rolled membrane of claim 1, wherein the compression spacers are configured to compress from a first thickness of about 0.050 inches to a second thickness of about 0.045 inches as the membrane is rolled.

3. The rolled membrane of claim 1, wherein the compression spacers are removably affixed to the membrane.

4. The rolled membrane of claim 1, wherein each of the compression spacers include a plurality of unconnected sections within the rolled membrane.

5. The rolled membrane of claim 1, wherein the compression spacers are not affixed to the membrane.

6. The rolled membrane of claim 1, wherein the membrane is a roofing membrane.

7. The rolled membrane of claim 1, wherein the pre-applied seam tape includes a release layer.

8. The rolled membrane of claim 7, wherein an exposed face of the release layer faces away outwardly from the core member.

9. The rolled membrane of claim 1, wherein the compression spacers are made of single face corrugated cardboard, the single face corrugated cardboard having a flat side and a corrugated side.

10. The rolled membrane of claim 9, wherein the flat side faces the core member.

11. A method of rolling a membrane material into a roll for subsequent shipping, comprising:

providing a core member;

providing a membrane having a width defined by a first edge and a second edge, wherein the membrane includes a pre-applied seam tape affixed to the first edge having a substantially uniform thickness of less than about 0.035 inches;

placing a first and second compression spacer substantially adjacent to the seam tape and the second edge, respectively; and rolling the membrane and compression spacers around the core member such that the pre-applied seam tape remains substantially uncompressed, wherein the compression spacers are compressed from a first thickness of about 0.050 inches to a second compressed thickness of about 0.045 inches.

12. The method of claim 11, further comprising applying tension to at least one of the compression spacers.

13. The method of claim 11, wherein the compression spacers are removably affixed to the membrane.

14. The method of claim 11, wherein the compression spacers are not affixed to the membrane.

15. A rolled roofing membrane, comprising:

a core member;

an EPDM membrane having a width defined by a first edge and a second edge, the membrane being rolled around the core member such that the first edge and the second edge are exposed;

a pre-applied seam tape affixed to the first edge, wherein the seam tape has a substantially uniform thickness of about 0.032-0.035 inches; and three compression spacers removably affixed to the membrane, the first and second compression spacers being disposed proximate to the seam tape and second edge, respectively, and the third compression spacer being disposed approximately midway between the first and second compression spacers, the compression spacers being constructed from cardboard material having a flat side and a corrugated side and having a compressed thickness between from about 0.010 and 0.013 inches greater than the substantially uniform thickness of the pre-applied seam tape, the compression spacers being configured to allow the seam tape to remain in a substantially uncompressed state such that the membrane is rolled uniformly on the core member without telescoping and with a uniform cross-sectional diameter along the width of the rolled membrane.

* * * * *